US006833662B2

(12) United States Patent
Harberts et al.

(10) Patent No.: US 6,833,662 B2
(45) Date of Patent: Dec. 21, 2004

(54) CATHODE RAY TUBE WITH ANTI-RINGING COIL

(75) Inventors: Dirk Willem Harberts, Eindhoven (NL); Ralph Wilhelmus Lambertus Johannus Dams, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/234,789

(22) Filed: Sep. 4, 2002

(65) Prior Publication Data

US 2003/0057820 A1 Mar. 27, 2003

(30) Foreign Application Priority Data

Sep. 5, 2001 (EP) ..... 01203345

(51) Int. Cl.[7] ..... H01J 29/76

(52) U.S. Cl. ..... 313/440; 313/439; 313/412; 313/415; 335/210; 335/212; 315/370

(58) Field of Search ..... 313/440, 439, 313/412, 415, 441; 335/210, 212; 315/370

(56) References Cited

U.S. PATENT DOCUMENTS 5,039,922 A * 8/1991 Ogasa et al. ..... 315/370

FOREIGN PATENT DOCUMENTS

| | | | | |
|---|---|---|---|---|
| JP | 61099252 A | * | 5/1986 | ..... H01J/29/76 |
| JP | 64031334 | | 2/1989 | ..... H01J/29/76 |
| JP | 06303623 A | * | 10/1994 | ..... H04N/9/28 |
| JP | 09320488 A | * | 12/1997 | ..... H01J/29/76 |
| WO | WO9934392 | | 7/1999 | ..... H01J/29/70 |
| WO | WO9966526 | | 12/1999 | ..... H01J/29/70 |

OTHER PUBLICATIONS

Patent Abstracts of Japan, Maruta Korehisa: "Deflection Yoke," Publication No. 61104543, May 22, 1989, Application No. 59225300, Oct. 26, 1984.

* cited by examiner

*Primary Examiner*—Nimeshkumar D. Patel
*Assistant Examiner*—Sikha Roy

(57) ABSTRACT

The invention relates to a cathode ray tube comprising means (5) for generating an electron beam (6,7,8), means (51) for deflecting the electron beam, and a coil (14') for influencing a deflection of the electron beam (6,7,8). The coil (14') comprises an electrically conductive coil holder (46) and coil windings (47,48) having an electrically conductive outer layer (44). The electrically conductive layer (44) of the coil wires (41) and the coil holder (46) cooperate with each other so as to form a conductive path A between successive coil windings (47,48). Due to the outer layer (44) of the wires and the conductive coil holder (46) an electrical path A between successive windings (47,48) is created that provides damping and by which ringing is suppressed.

6 Claims, 3 Drawing Sheets

CATHODE RAY TUBE WITH ANTI-RINGING COIL

The invention relates to a cathode ray tube comprising means for generating an electron beam, means for deflecting the electron beam, and a coil for influencing a deflection of the electron beam.

WO 99/34392 (attorneys' docket PHN 16.716) describes a color display device comprising a cathode ray tube including an electron gun for generating three electron beams, a color selection electrode, deflecting means for deflecting the electron beams located at a deflection plane, and first and second influencing means to dynamically influence the convergence of the electron beams, to decrease a distance between the electron beams at a location of the deflection plane. The deflecting means comprise a set of line coils and a set of frame coils separated by a coil holder from the line coils and a yoke ring, which surrounds the frame coils. The first and second influencing means are positioned at some distance from each other. The first influencing means is positioned close to the electron gun and is referred to as the "gun quadrupole", whereas the second influencing means comprises a coil for generating a magnetic quadrupole field, which is wound around the yoke ring and is referred to as the "yoke quadrupole".

It has been observed that during operation a pattern of alternating lighter and darker vertical bars on one side of the screen is visible. This pattern is attributed to ringing of the yoke quadrupole. Ringing is a phenomenon caused by high-frequency electromagnetic oscillations in coils. Ringing may also occur in other coils that influence the deflection of the electron beam.

It is an object of the invention to suppress ringing caused by coils that influence the deflection of the electron beam. The cathode ray tube according to the invention is characterized in that the coil comprises an electrically conductive coil holder and coil windings, having an electrically conductive outer layer. As a result the electrically conductive layer of the coil wires and the coil holder cooperate with each other so as to form a conductive path between successive coil windings.

The yoke quadrupole comprises many wire packages that are partly or completely separated from each other. Further, the wires are wound not very close together within each package and even tend to spread out, i.e. within a package the wires hardly touch each other. The conductive path between the coil windings provides a damping mechanism for the ringing phenomenon, by which it is completely suppressed.

The use of an electrically conductive coil holder as such in order to suppress ringing is known from JP 09320488. The holder that has a relatively high impedance is used in a deflection unit that comprises a set of line and frame deflection coils and is made from a mould material in which carbon is mixed. This type of ringing, known as common-mode ringing, can be explained as follows. In the deflection unit, the line coils are positioned close to the frame coils. At relatively high frequencies a displacement current can pass through a parasitic capacitance that exists between the line and frame coils. In that manner, a common-mode current flows in both line and frame coils and can return through drive electronics. By making the coil holder weakly electrically conductive a shield structure is created that prevents the common-mode current to flow from the line coils to the frame coils. It is to be noted that even in the presence of such a shield structure ringing of individual coils can still occur, in that case a so-called differential mode current flows from one terminal of the coil (through the coil) to a second terminal of the coil. Applying a shield structure therefore does not prevent differential mode ringing, which is the type of ringing occurring e.g. in the yoke quadrupole coil.

The use as such of windings having an electrically conductive outer layer, preferably by using so-called ringing free wire, in line and frame coils is known from WO 99/66526. The line deflection coil system as well as the frame deflection coil system can be regarded as a resonance circuit with a natural frequency. The impedance of the circuit is frequency-dependent and exhibits a maximum at or around the natural frequency of the resonance circuit. The steeper the slope of the resonance characteristic, the more ringing occurs. A measure of the slope of the resonance characteristic is the width of the resonance peak. The application of the conductive layer increases the width of the resonance peak, so that resonances in the line deflection coil system are damped more rapidly, which reduces ringing. For effective ringing suppression it is important that the coils are closely packed, thus enabling a close contact between the conductive outer layer of the wire of the various coil windings. This is achieved in the line and frame coils of the mussel-type during the coil manufacturing process when pressing and backing steps are applied to the coils.

In the case of the yoke quadrupole coil, the use of ringing free wire alone does not prevent ringing. The windings of this coil are not closely packed as no compacting process has taken place, and the coil windings do not make sufficient electrical contact with each other.

The invention effectively suppresses ringing in coils wherein the wires are not closely packed, e.g. in the case of the yoke quadrupole coil. The conductive coil holder provides a conductive path between windings of different packages of the coil. The coil holder also improves the electrical contact between windings within a package, i.e. the windings that are in contact with the coil holder. It should be noted that in this case, the coil holder does not act as a shield, but is required for providing an electrical path. It is only in the cooperation between the coil holder and the ringing free wire that the prevention against ringing occurs.

This aspect as well as other aspects of the invention are defined by the independent claims.

Advantageous embodiments of the invention are defined by the dependent claims.

These and other aspects of the invention will be elucidated with reference to the embodiments described hereinafter.

BRIEF DESCRIPTION OF DRAWINGS

In the drawings.

The figures are not drawn to scale. In general, identical components are denoted by the same reference numerals in the figures.

Figure 1:
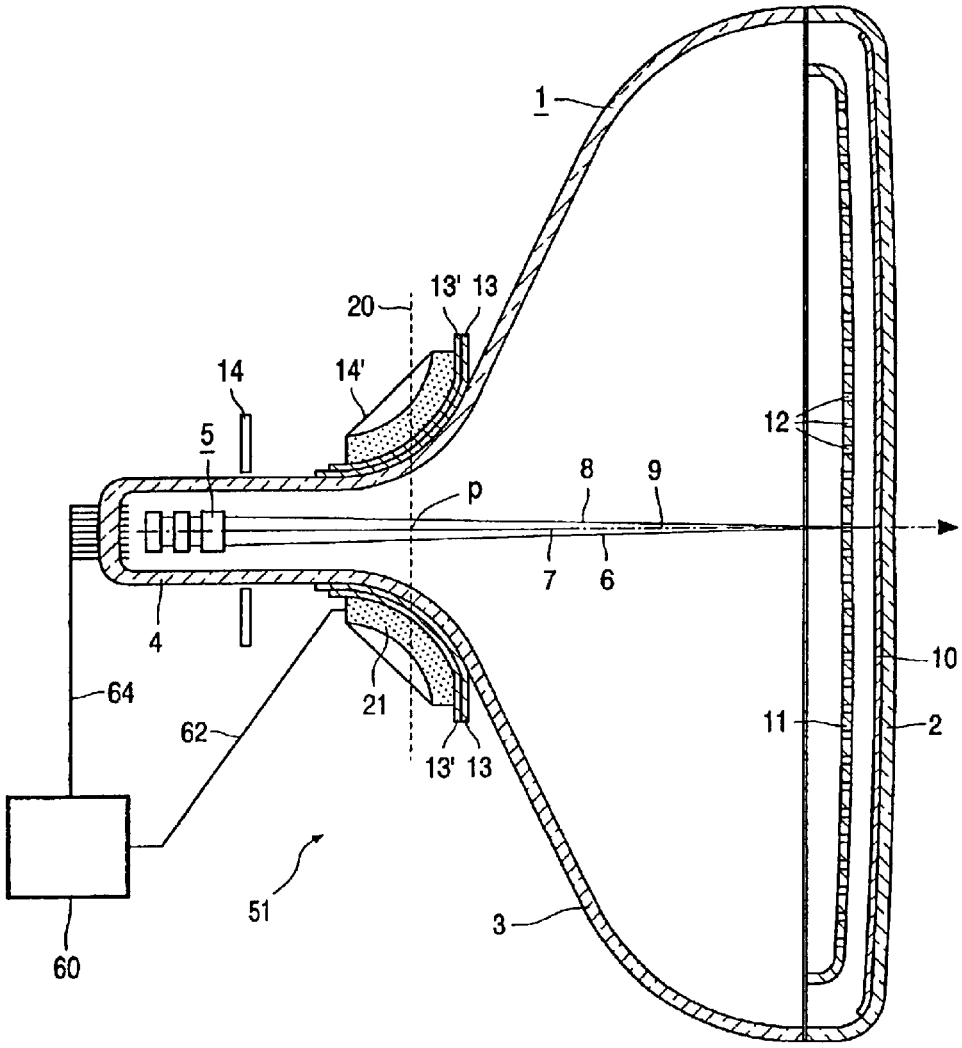
FIG. 1 is a sectional view of a cathode ray tube.

The display device shown in FIG. 1 comprises a cathode ray tube, in this example a color display tube, having an evacuated envelope 1 which includes a display window 2, a cone portion 3 and a neck 4. In the neck 4 there is arranged an in-line electron gun 5 for generating three electron beams 6, 7 and 8 which extend in one plane, the in-line plane, which is in this case the plane of the drawing. In the undeflected state, the central electron beam 7 substantially coincides with the tube axis 9.

The inner surface of the display window is provided with a display screen 10. The display screen 10 comprises a large number of phosphor elements luminescing in red, green and blue. On their way to the display screen, the electron beams are deflected across the display screen by way of an electromagnetic deflection unit 51 and pass through a color selection electrode 11 which is arranged in front of the display window 2 and which comprises a thin plate having apertures 12. The three electron beams 6, 7 and 8 pass through the apertures 12 of the color selection electrode at a small angle relative to each other and hence each electron beam impinges only on phosphor elements of one color. The deflection unit 51 comprises, in addition to a coil separator 13, line and frame deflection coils 13' for deflecting the electron beams in two mutually perpendicular directions and a yoke ring 21 that surrounds the line and frame coils. The display device further includes means for generating voltages, which during operation are fed to components of the electron gun via feedthroughs. The deflection plane 20 is schematically indicated as well as the distance p between the electron beams 6 and 8 in this plane.

The color display device comprises two electron beam convergence influencing units 14, 14', whereby a first unit 14 is used, in operation, to dynamically bend, i.e. as a function of the deflection in a direction, the outermost electron beams towards each other, and a second unit 14' serves to dynamically bend the outermost electron beams in opposite directions.

The two units 14, 14' are positioned at some distance from each other, and are used to vary the distance p, as a function of the deflection, in a such a manner that the distance p decreases as a function of the deflection in at least one direction. The first unit 14 is positioned close to the gun and is referred to as "gun quadrupole", whereas the second unit 14' is located near the deflection unit and will be referred to as the "yoke quadrupole".

A further aspect of the invention comprises a display apparatus comprising the cathode ray tube according to the invention, and circuitry 60 for providing control signals 62 and display signals 64 to the display.

Figure 2:
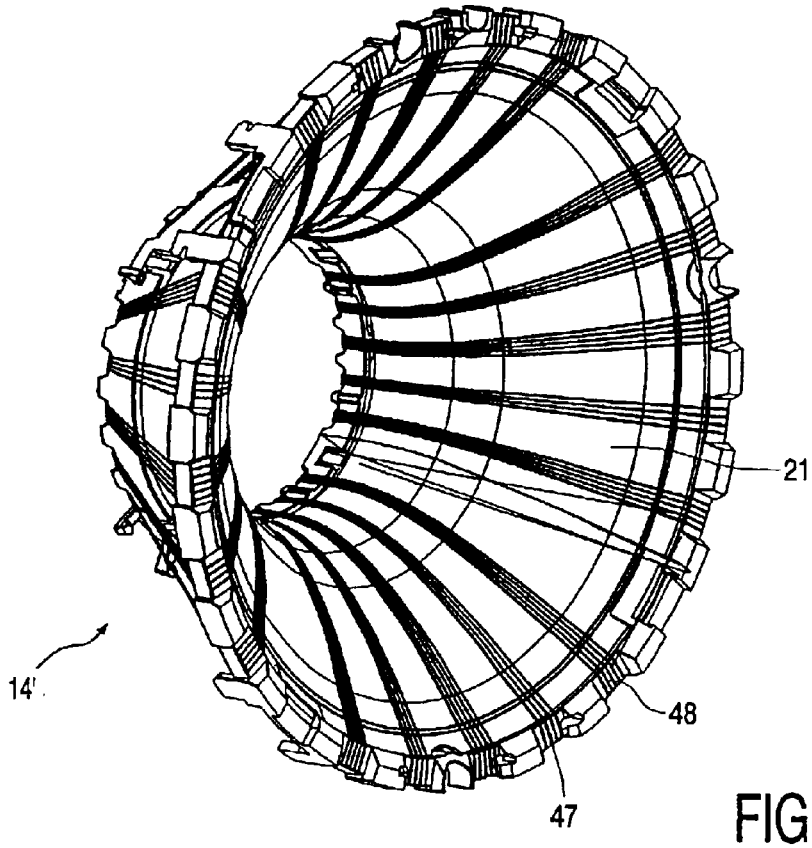
FIG. 2 is a sectional view of a yoke quadrupole according to the invention.

FIG. 2 shows a schematic cross-section of the yoke quadrupole 14', which comprises packages of electrically conductive wires that are toroidally wound around the yoke ring 21 approximately according to a winding density $N(\phi)=N_0\cos(2\phi)$. $N_0$ denotes the winding density at $\phi$ equal to 0°, and the sign of $N(\phi)$ denotes the winding direction. The yoke ring 21 is used as coil holder for the quadrupole coil. The coil has many wire packages 47,48 that are completely separated from each other. Further, wires are not closely packed within each package and even tend to spread out, i.e. within a package the wires hardly touch each other. For instance an inner surface of the yoke ring 21 is electrically conductive and provides an electrical path between the successive wire windings 47,48.

A (weakly) conductive path is provided between the outer layers of the wires in different packages by a weakly conductive layer on for instance the wire holders or on the ferrite core (where it touches the wire packages). Note that the purpose of this conductive layer is to provide a weakly conductive electrical path. It does not function as e.g. an electrical shield. This is especially apparent when the conductive layer is provided on a wire holder on top of the ferrite core since this conductive layer is not positioned between different coil types. Further note that an electrical shield is sometimes proposed to prevent a common-mode current to flow from one coil to another. Oscillations inside a coil can then still occur, whereas in the device according to the invention all high-frequency oscillations are damped.

Figure 3:
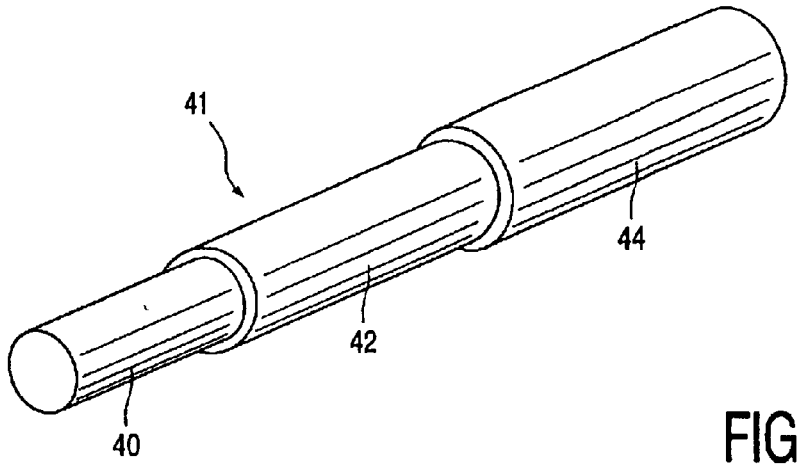
FIG. 3 is a cross-section of winding wire having an electrically conductive outer layer.

FIG. 3 shows a schematic drawing of the electrically conductive wire (ringing free wire) that is preferably used for winding the coil according to the invention. The ringing free wire 41 has a conductive core 40 comprising copper, said core being surrounded by an electrically isolating layer 42 and an outer layer 44 that comprises graphite particles thus making the outer layer electrically conductive. In an alternative embodiment, the coil 14' has been given an electrically conductive outer layer by submersing the coil 14' in an electrically conductive suspension, as described in WO 99/66526.

Figure 4:
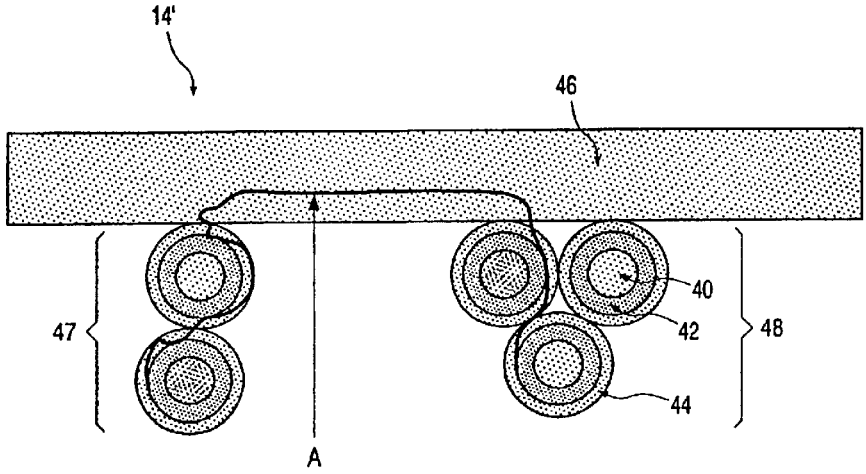
FIG. 4 is a cross-section of part of the coil according to the invention.

FIG. 4 shows a cross-section of a part of the coil according to the invention. The coil 14' comprises a coil holder 46 around which packages 47,48 of ringing free wire having a conductive outer layer 44 have been wound. For a proper anti-ringing functionality it is necessary that the outer layer of the ringing free wires 41 and the electrically conductive holder 46 cooperate with each other, so as to form a weakly conductive or damping path A between successive coil windings 47,48. It suffices if only an outer surface of the coil holder, in particular at the side of the coil windings is made electrically conductive. The coil holder 46 also improves the electrical contact between windings within a package (i.e. those windings that touch the coil holder). Both differential-mode as well as common-mode ringing are suppressed by the invention.

The conductive coil holder 46 can be made from a weakly conductive synthetic material. Alternatively, a conventional coil holder can be coated or painted with e.g. a suspension containing graphite particles to obtain a weakly conductive outer layer.

Figure 5:
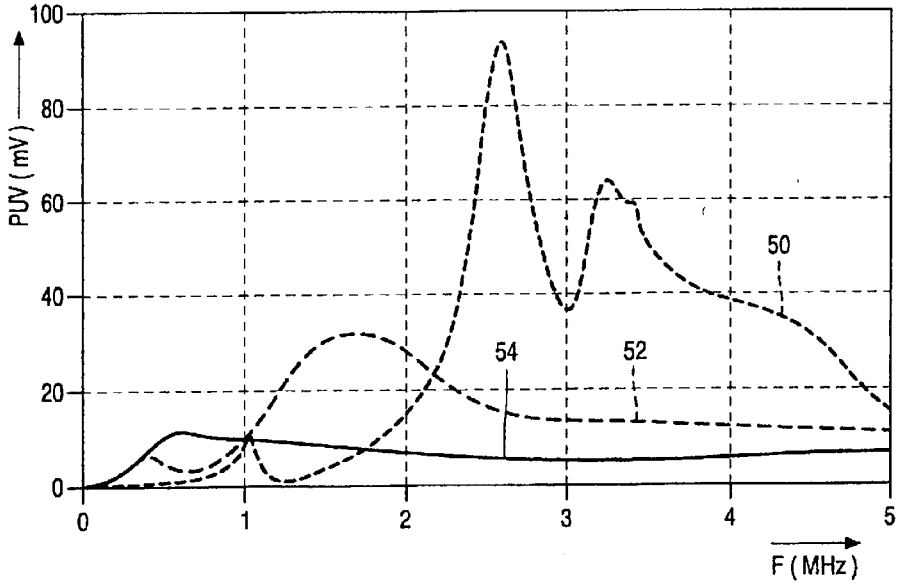
FIG. 5 shows the magnetic frequency response of various coils.

Results of ringing suppression are shown in FIG. 5. Curve 50 is the ringing performance of the conventional yoke quadrupole. Depicted is the ringing behavior of the coil as represented by the so-called pick-up voltage PUV as a function of the frequency F. Details on this ringing measurement technique can be found in D. W. Harberts, Proceedings of the SID International Symposium, May 1999, Digest of Technical Papers, Vol.15, pages 898–901. A high and sharp resonance peak is found in the range of 2–3 MHz, which corresponds to a high sensitivity to ringing.

Curve 52 represents the results of a yoke quadrupole using ringing free wire with a conventional non-conductive holder. The outer layer of the ringing free wire within the windings make some electrical contact but due to the open structure of the coil not all windings are in close contact with each other. Consequently, ringing is only partly suppressed and the sensitivity of the coil to resonate is still present as can be seen from a peak in the range of 1–2 MHz.

Curve 54 represents the ringing behavior of a yoke quadrupole wherein ringing free wire is applied together with a conductive coil holder. The resonance peak is much lower and broader, showing the effectiveness to suppress ringing.

With the above magnetic frequency response measurement method the conductivity of the coil holder can be optimized. When the conductivity is too low suppression of ringing will be insufficient. On the other hand, when the conductivity is too high, eddy currents will occur, which deteriorate the electron optical performance of the yoke quadrupole in view of unwanted power dissipation. Good results were obtained when the specific electrical resistivity of the conductive layer of the coil holder was in the range of 100 and 1000 Ohm/square.

The described method for the suppression of ringing can also successfully be applied to other types of coils that influence the deflection of the electron beam and that are not closely packed. Examples of such coils are the gun quadrupole, the so-called scan velocity modulation (SVM) coil, other auxiliary coils as well as frame coils that are toroidally wound and that consequently do have a relatively open structure.

In summary, the invention relates to a cathode ray tube comprising means 5 for generating an electron beam 6,7,8, means 51 for deflecting the electron beam 6,7,8, and a coil 14' for influencing a deflection of the electron beam. The coil comprises an electrically conductive coil holder 46 and coil windings 47,48. Preferably, the coil windings 47,48 have been built-up from electrically conductive wire 41, having an electrically conductive outer layer 44. The electrically conductive layer of the coil wires 44 and the coil holder 46 cooperate with each other so as to form a conductive path A between successive coil windings 47,48. Due to the electrical path A between successive windings 47,48 damping is provided and ringing is suppressed.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of other elements or steps than those listed in a claim. The word "a" or "an" preceding an element does not exclude the presence of a plurality of such elements.

What is claimed is:

1. A cathode ray tube comprising:

means for generating an electron beam, means for deflecting the electron beam, and a coil for influencing a deflection of the electron beam, the coil comprising an electrically conductive coil holder and coil windings having an electrically conductive outer layer.

2. A cathode ray tube according to claim 1, wherein an electrical resistance of the electrically conductive coil holder varies between 100 and 1000 Ohm/square.

3. A cathode ray tube according to claim 1, wherein the coil holder comprises an electrically conductive outer layer.

4. A coil for influencing a deflection of an electron beam of a cathode ray tube, the coil comprising an electrically conductive coil holder and coil windings having an electrically conductive outer layer.

5. A coil according to claim 4, wherein an electrical resistance of the electrically conductive coil holder varies between 100 and 1000 Ohm/square.

6. A display apparatus comprising:

the cathode ray tube according to claim 1, and means for providing control signals and display signals to the tube.

* * * * *